US005565848A

United States Patent [19]

Leyden et al.

[11] Patent Number: 5,565,848

[45] Date of Patent: Oct. 15, 1996

[54] SECURITY APPARATUS FOR MONITORING AN ARTICLE

[75] Inventors: Roger J. Leyden, Willow Springs; Terrance J. Surma, Bloomingdale, both of Ill.

[73] Assignee: Se-Kure Controls, Inc., Franklin Park, Ill.

[21] Appl. No.: 365,964

[22] Filed: Dec. 29, 1994

[51] Int. Cl.[6] ..... G08B 13/14

[52] U.S. Cl. ..... 340/572; 340/568; 340/691; 340/693

[58] Field of Search ..... 340/568, 691, 340/693, 572

[56] References Cited

U.S. PATENT DOCUMENTS

| | | | |
|---|---|---|---|
| 3,840,870 | 10/1974 | Norrod | 340/568 |
| 3,972,039 | 7/1976 | Marshall | 340/568 |
| 4,300,130 | 11/1981 | Fotheringham et al. | 340/568 |
| 4,772,878 | 9/1988 | Kane | 340/568 |
| 5,003,292 | 3/1991 | Harding et al. | 340/568 |
| 5,072,213 | 12/1991 | Close | 340/568 |
| 5,172,098 | 12/1992 | Leyden et al. | 340/568 |
| 5,241,297 | 8/1993 | Goodman | 340/568 |

OTHER PUBLICATIONS

Protex International Corp. catalog pp. D18, D20, D23, D30, D34, D35 and D39.

*Primary Examiner*—John K. Peng
*Assistant Examiner*—Benjamin C. Lee
*Attorney, Agent, or Firm*—Wood, Phillips, VanSanten, Clark & Mortimer

[57] ABSTRACT

A security apparatus for attachment to an article to be monitored. The security apparatus has a body, first structure for maintaining the body operatively connected to an article to be monitored, and second structure on the body for at least one of a) mechanically connecting the body to a support and b) changing from a first state with the body operatively connected to an article to be monitored into a second state with the body at least partially separated from an article to be monitored. The body has at least a part that is conformable to a surface on an article to which the security apparatus is attached.

29 Claims, 3 Drawing Sheets

SECURITY APPARATUS FOR MONITORING AN ARTICLE

BACKGROUND OF THE INVENTION

1. Field of the Invention

This invention relates to security systems and, more particularly, to a component of a security system that can be attached to an article to facilitate monitoring thereof so as to detect unauthorized removal of the article.

2. Background Art

Many retail establishments display merchandise in such a manner that prospective purchasers are allowed to pick articles up and manipulate them as they would in normal use, for purposes of inspection and testing. For example, electronics stores commonly display large quantifies of cellular phones, camcorders, radios, etc. in this manner. Security systems are necessary to prevent unauthorized removal of these products from the display areas.

Ideally, such security systems afford the prospective customer the freedom to pick up, inspect, and in certain cases operate the article without substantial interference from the system. These systems are at the same time designed to limit, within a prescribed range, the distance the prospective purchaser can transport the article from the display.

It is known to use purely mechanical systems, such as cables, to accomplish the above end. In certain environments, these mechanical systems are easily defeated, as by cutting or breaking loose the cable anchor. With such systems, the store operator is given no sensory indication that the system has been defeated.

Electronic systems, such as shown in U.S. Pat. No. 5,172,098, afford a more sophisticated monitoring tool to the store owner. The system in U.S. Pat. No. 5,172,098 utilizes a separate sensor for each article to be monitored. The system is armed by attaching each of the active sensors to an article to be monitored. A double-sided, adhesive pad is attached to a surface on the sensor housing from which an actuating switch button projects and a mounting surface on an article. With this arrangement, the button is captive between the sensor housing and article in a depressed state to close a monitoring circuit. If the circuit is broken, either by prying loose the sensor from the article or severing a cord communicating between a sensor and a control unit, an alarm sounds. LED's on splitter boxes, remote from the articles and on the sensors, allow the store owner to trace the article that has been tampered with.

The above system has been highly commercially successful. For this system to operate effectively, it is critical that the sensor housing be positively secured to the article to be monitored with the actuating button depressed to arm the system. Currently available adhesives are tenacious enough to maintain the sensors positively against a flat surface on the articles.

However, a large number of consumers products do not have a flat surface that lends itself to the positive mounting of the sensor housing. Many consumer products are of late being designed with curved contours to produce a streamlined appearance. For example, hand held camcorders and cellular phones often have a rounded shape that facilitates comfortable grasping thereof as well as produces a "high tech" look. This type of product may be totally lacking a flat surface with an area substantial enough to accommodate the confronting face on the sensor housing.

In the event that the article to be monitored does not have a suitable flat surface for attachment of the sensor housing, two conditions commonly occur. In the event that the sensor is attached to a convex surface, less than the entire exposed surface on the adhesive pad on the sensor housing makes facial contact with the surface on the article. The sensor housing then has a contact area that is less than what was contemplated in the original design to assure a positive bond between the sensor housing and article. The adhesive pad on the flat contacting surface of the sensor may not have a sufficient contact area on the article to produce an effective bond. The sensor may then be relatively easily shifted, as by a rocking motion, on the article. The sensor is in this condition prone to breaking free of the article.

Even if a relatively substantial contact area is established between the adhesive pad and the convex article surface, there may remain a gap between the sensor housing and article surface at one or more edges of the housing. This facilitates prying loose of the sensor housing by a thief.

On some articles, the most accessible surface on which the sensor can be placed has a concave shape. When the sensor is applied, it may bridge two points on the surface. This results in less than full contact between the sensor housing mounting surface and the article. Accordingly, the strength of the bond is compromised.

Further, the actuating button may be less than fully depressed with the sensor housing operatively connected to the article in this state. The result may be that a slight shifting of the sensor housing on the article may break the circuit so as to produce an alarm, when in fact there has been no security breach.

It is impractical to custom shape sensors to individual articles, and thus those in the art have merely contended with the above problems.

SUMMARY OF THE INVENTION

The present invention is specifically directed to overcoming the above enumerated problems in a novel and simple manner.

In one form of the invention, a security apparatus is provided for attachment to an article to be monitored. The security apparatus has a body, first structure for maintaining the body operatively connected to an article to be monitored, and second structure on the body for at least one of a) mechanically connecting the body to a support and b) changing from a first state with the body operatively connected to an article to be monitored into a second state with the body at least partially separated from an article to be monitored. The body has at least a part that is conformable to a surface on an article to which the security apparatus is attached.

With the inventive structure, the body can accommodate differently-shaped surfaces on consumer articles to permit positive connection thereto.

The security apparatus may be used in combination with structure for sensing the state of the second structure and producing a sensory indication as an incident of the sensing structure sensing that the second structure is in the second state.

In one form, the body is made from a material that can be reconfigured into a plurality of different shapes and maintain itself in the plurality of different shapes.

With this type of material, once the body is conformed to a particular article, the body will not spring back to its undeformed state. As a result, a positive bond between the body and article to be monitored can be maintained without fear of the body peeling off by reason of its own reconfiguration.

One suitable material for the part of the body is a thermal setting rubber.

The second structure can be a mechanical connection, such as a cable that is a braided metal wire, a solid metal wire, a hardened metal wire, or the like.

The second structure may include a housing containing at least part of an electrical circuit. The part of the body can be made from a first material with the housing being made from a second material that is different than the first material.

As one example, the housing may be made from a hard plastic.

In one form, the housing has a substantially fixed, rigid shape, with there being structure cooperating between the housing and body for allowing the housing to be press fit into an operative position on the body.

This cooperating structure may include a male element on one of the body and housing and a female element on the other of the body and housing, with the male and female elements being complementary in shape and the male element residing within the female element with the housing in the operative position on the body.

In one form, the male element is an annular rib with the female element being a complementary annular groove. With the housing and body separate from each other and the housing placed in a first position, the housing can be pressed into its operative position. There is a part of the other of the body and housing that abuts to the rib as the housing is moved from its first position into its operative position, whereupon the body deforms to allow the rib to seat in the groove with the housing in the operative position. This makes possible a snap-fit type of engagement.

The part of the body can be made from a deformable material that can be conformed to an underlying surface on an article to be monitored. The first structure may be an adhesive that acts between the first surface and an underlying surface on an article to be monitored.

The first surface can be made from thermal setting rubber.

The body may have a thickened portion defining a receptacle to accept the housing. The receptacle may extend partially or fully through the body.

In one form, the electrical circuit includes a switch having a button mounted to the housing for movement between a first position and a second position. The electrical circuit is open with the button in the first position. The button projects from the housing and is pressed against an article to be monitored and urged by an article to be monitored from the first position into the second position with the body in an operative position on an article to be monitored.

The invention can be used in combination with structure for sensing the state of the second structure and producing a signal responsive to the sensing structure sensing that the second structure is in the second state, with there being structure responsive to the signal for producing a sensory indication at at least one of a) the security apparatus and b) a location remote from the security apparatus.

An electrical lead may define part of the electrical circuit with there being structure for sensing that the electrical circuit is broken and producing a sensory indication as an incident of the sensing structure sensing that the circuit is broken.

The invention contemplates the combination of the above structure with an article to be monitored.

In another form of the invention, a security system is provided for monitoring an article. The system includes a body, first structure for maintaining the body operatively connected to an article to be monitored, a control unit remote from the body, and structure for establishing an electrical circuit between the control unit and the body. The control unit includes first structure for sensing that the electrical circuit has been broken and generating a signal indicative of the fact that the electrical circuit is broken. Structure is provided on at least one of the control unit and body for giving a sensory indication that the electrical circuit is broken in response to the signal being generated by the control structure. The body has at least a part thereof that is conformable to a surface on an article to which the body is attached.

In one form, the body has a thickness taken transversely to a surface on an article to which the body is attached. The body has a central portion with a first thickness and a peripheral flange having a thickness less than the first thickness.

The flange may be made from thermal setting rubber.

The thickened central portion of the body may define a receptacle for a housing which contains part of the electrical circuit.

DETAILED DESCRIPTION OF THE DRAWINGS

Figure 1:
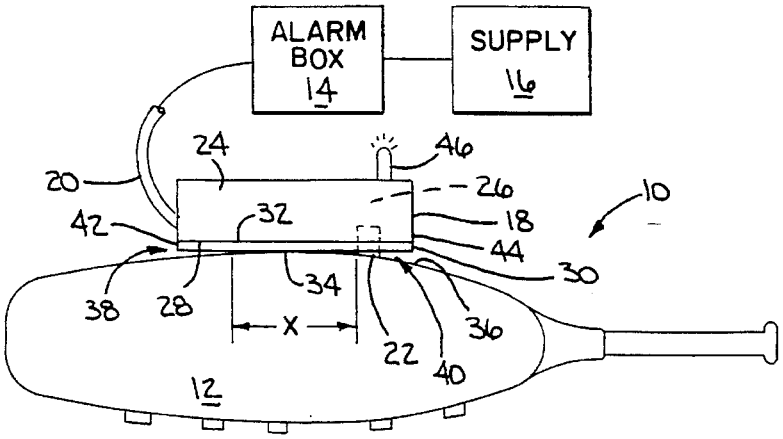
FIG. 1 (PRIOR ART)
FIG. 1 is a side elevation view of a cellular telephone with a sensor on a conventional security system connected thereto.

In FIG. 1, a conventional security system is shown at 10 for a consumer article, in this case a portable cellular telephone 12. The system 10 is of the same general type shown in U.S. Pat. No. 5,172,098, which is incorporated herein by reference. Briefly, the system 10 includes an alarm box 14 powered by an electrical supply 16. A plurality of sensors 18 (one shown) are electrically connected to the alarm box 14. A monitoring circuit is defined through a wire lead 20 between the alarm box and the sensor 18.

The sensor 18 has an associated actuating button 22 that is spring loaded outwardly from the housing 24 on the sensor 18. In this outward position, a contact (not shown) associated with the button 22 repositions to open the monitoring circuit both with the system unarmed at start-up and with the system breached, as described below. The monitoring circuit is closed by depressing the actuating button 22 i.e. moving it upwardly in FIG. 1 into the housing 24.

The sensor housing 24 may be formed from a rigid plastic to define an internal space 26 for various electrical components (not shown). The housing has a flat, bottom wall 28 which is designed to be placed facially against the article 12. A double-sided adhesive layer 30 has one side 32 bonded to the flat bottom wall 28 of the sensor housing 24 and an opposite surface 34 bonded to a surface 36 on the article 12.

By operatively connecting the sensor 18 to the article 12 in the manner described above, the facing surface 36 on the article 12 depresses the button 22 to complete the circuit. The adhesive layer 30 is intended to maintain the sensor 18 in a fixed position on the article 12 wherein the button 22 remains depressed.

In a situation where the mounting surface on the article 12 is flat, the bottom wall 28 of the sensor 18 is facially presented over its entire extent to the confronting article surface. However, the bottom wall 28 will not conform adequately to a non-flat surface, such as the convex surface 36 shown on the article 12 in FIG. 1.

In the event that the mounting surface is convex, such as the surface 36, only that part of the sensor wall 28, designated by the dimension X in FIG. 1, is bonded to the article surface 36. Gaps 38, 40 result between the ends 42, 44 of the housing 24 and the article surface 36. Aside from the fact that the bonded area of the wall 28 is reduced from that desired, the gaps 38, 40 afford a convenient area to accommodate a prying tool or even a user's nails through which the sensor 18 can be freed.

Depending upon the degree of curvature of the surface 36, the sensor 18 may be positioned so that the button 22 is only partially depressed. In a worst case, the extent of depression of the button 22 may be such that the circuit is not completed. Alternatively, the circuit may be closed to the point that any slight rocking of the housing 18 on the surface 36 may cause the button 22 to project out sufficiently to break the circuit.

After the system is armed, breaking of the circuit causes the alarm box 14 to produce an audible signal indicative of a security breach. The sensor 18 also has an LED 46 thereon that indicates the state of the circuit.

Figure 2:
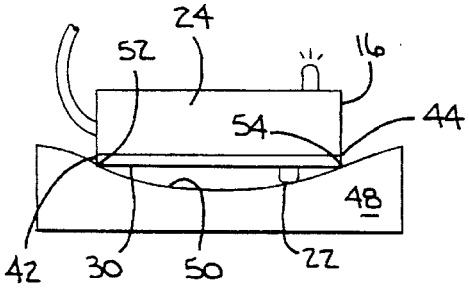
FIG. 2 (PRIOR ART)
FIG. 2 is a side elevation view of a conventional sensor, as in FIG. 1, attached to a concave surface on an article to be monitored.

Another field condition is shown in FIG. 2 with an article 48 therein having a concave surface 50. With the sensor 16 of FIG. 1 attached to the article 48, the ends 42, 44 of the housing 24 bridge two spaced points 52, 54 on the article 48 so that very little of the adhesive layer 30 makes contact with the surface 50. This may result in a condition wherein the button 22 does not depress sufficiently to close the monitoring circuit. In a worst case, the button 22, even if depressed sufficiently to close the circuit, may be visible and accessible to be maintained depressed while the sensor 16 is removed. With a reduced bonding area, removal of the sensor 16 is facilitated.

As demonstrated initially with reference to FIGS. 3–6, the present invention obviates the above problems by providing a security apparatus, as shown at 60, for connection to an article to be monitored, which apparatus 60 includes a body 62 with a surface 64 that is conformable to differently shaped surfaces on an article to be monitored.

More particularly, the apparatus 60 is part of a system at 66 which, as in the system 10, defines a monitoring circuit between a housing 68 on the body 62 and a sensing/control means 70.

In the version shown, the housing 68 contains all of the electrical components on the apparatus 60. The housing 68 is preferably made from a rigid material, such as a hard plastic. An end 72 of a cord 74, connecting between the apparatus 60 and sensing/control means 70, is embedded in the housing 68. The housing 68 also provides a rigid support for an LED 76 and an actuating button 78, which are electrically interconnected in the monitoring circuit through a means, shown schematically at 80 in FIG. 3. A suitable construction for the electrical components within the housing 68 is shown in U.S. Pat. No. 5,172,098. The precise construction of the electrical components within the housing 68 does not form a part of the invention herein. It suffices to say that the housing 68 maintains the components, including the cord 74, LED 76, button 78 and means 80 in a desired relationship and provides strain relief on the cord 74.

The system 66 is armed by depressing the button 78 on the housing 68 so that a contact 82, associated with the button 78, completes the monitoring circuit. The button 78 is normally biased by a spring 84 to its extended state, wherein the contact 82 withdraws to open the monitoring circuit.

In arming the system, depression of the button 78 causes illumination of the LED 76. Once the system is armed, and the button 78 extended, the monitoring circuit is broken, which is detected by the sensing/control means 70, which thereby gives a sensory indication of this condition that may be audible or visual in nature.

According to the invention, the body 62 is made from a material that can be reconfigured into a plurality of different shapes and that maintains itself in the plurality of different shapes without any external force(s) being applied to the body 62. In a preferred form, the body 62 is made from a thermal setting rubber. The thermal setting rubber can be reconfigured and will retain a plurality of reconfigured states. A conventional plastic flexible material, while reconfigurable, tends to reassume its undeformed state. The thermal setting rubber, in the same manner as a putty, will retain different shapes into which it is configured so that there is little tendency of the body 62 to peel off.

Accordingly, the surface 64 of the body 62 can be essentially molded around a plurality of different shapes. For example, in FIG. 3, the surface 64 is conformed to a number of different undulations on the surface 86 of an article 88 that is to be monitored.

An adhesive layer 90 is interposed between the body surface 64 and the article surface 86 and maintains the body 60 operatively connected to the article 88. Accordingly, regardless of the shape of the article surface 86, virtually the entire area of the body surface 64 can be conformed to the underlying article surface 86.

Figure 5:
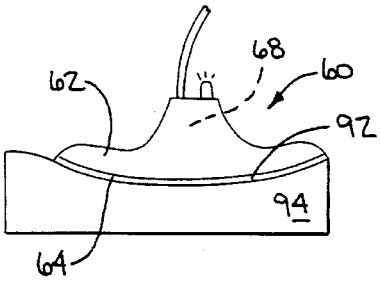
FIG. 5 is a side elevation view of the inventive security apparatus attached to a concave surface on an article to be monitored.

In FIG. 5, the surface 64 of the body 62 is shown conformed to a concave surface 92 on an article 94. It can be seen that the same conforming relationship is established between the body surface 64 and the article surface 92.

Figure 4:
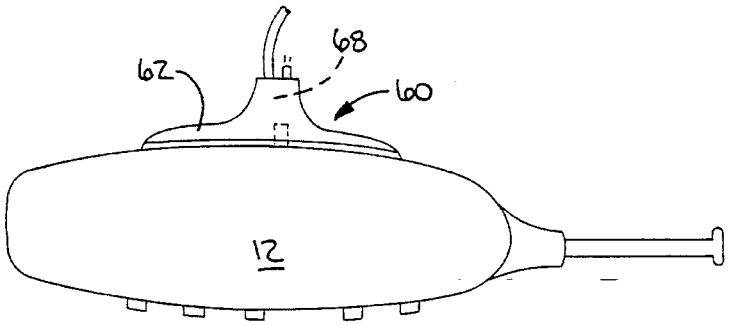
FIG. 4 is a side elevation view of the inventive security apparatus attached to a cellular telephone.

The advantage of the inventive apparatus 60 compared to the prior art can be seen by viewing the apparatus 60 in FIG. 4 attached to the same cellular telephone 12 as is the sensor 18 of the prior art in FIG. 1. Since the sensor 18 and apparatus 60 have the same general overall dimensions, a substantially greater contact area is established between the body 62 and the apparatus 60 as compared to the rigid sensor housing 24.

To facilitate manufacture of the apparatus 60, the body 62 is provided with a pre-formed receptacle for the housing 68. The receptacle 96 is defined from the surface 64 fully through the body 62. The receptacle 96 and housing 68 have complementary, generally truncated, conical shapes.

In the version shown, the housing 68 has an upper annular rib 98 and a lower annular rib 100. By initially directing the cord 74 upwardly through the receptacle 96, the housing 68 can be freely pressed into the receptacle 96. As this occurs, the rib 98 encounters a necked down portion 102 on the inside surface 104 of the body 62 bounding the receptacle 96. The rib 98 progressively deforms the body outwardly to allow the rib 98 to move into vertical alignment with an annular groove 106 at the top of the body 62. The body 62 will have enough memory to effectively cause a snap fit type of connection to be established between the rib 98 and groove 106.

A similar arrangement of elements is provided at the bottom of the housing 68 and body 62. That is, the rib 100 encounters a necked down portion 108 on the body 62 and effects outward deformation thereof as the housing 68 is squeezed upwardly into the receptacle 96. With the housing 68 and body 62 operatively connected, the rib 100 seats in a complementary groove 110 in the body simultaneously as the rib 98 seats in the groove 106. This connection is rigid enough that the housing 68 and button 78 are positively oriented so that placement of the body 62 against an article causes the desired depression of the button 78.

Figure 3:
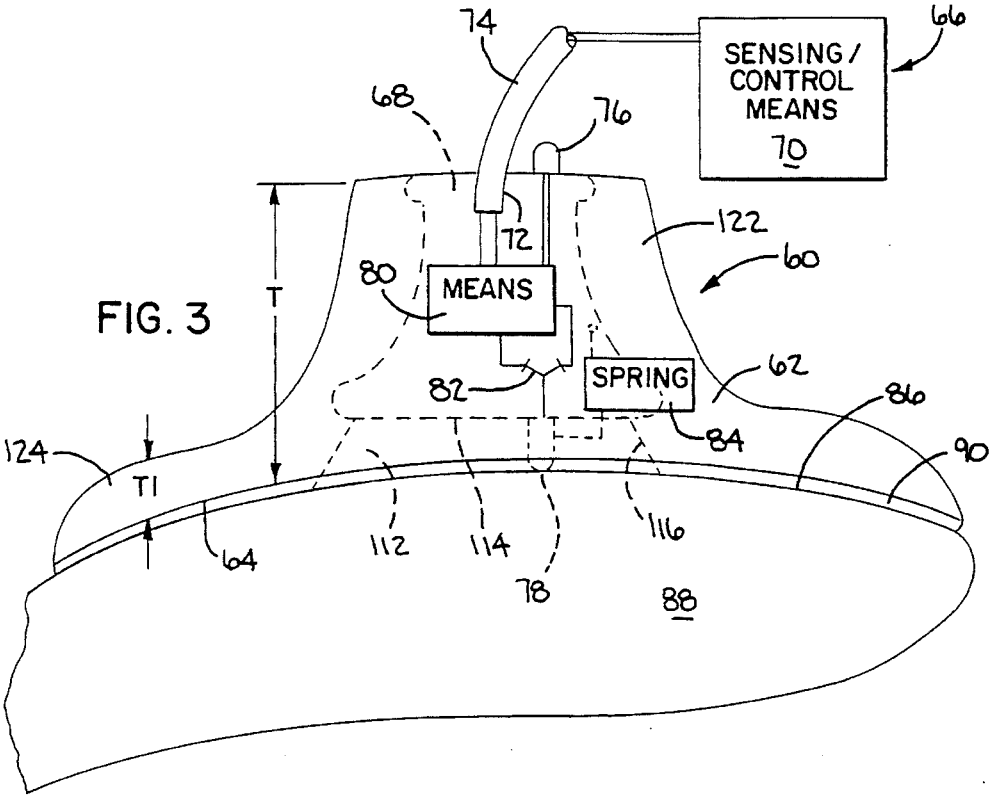
FIG. 3 is a side elevation view of a security system for monitoring an article, including a security apparatus for attachment to an article, according to the present invention.

As seen in FIG. 3, a slight void 112 may be maintained between the bottom surface 114 of the housing 68 and the body surface 64. This void 112 allows the wall 116 of the body 62 around the void 112 to collapse inwardly to give additional flexibility to the body 62.

Figure 6:
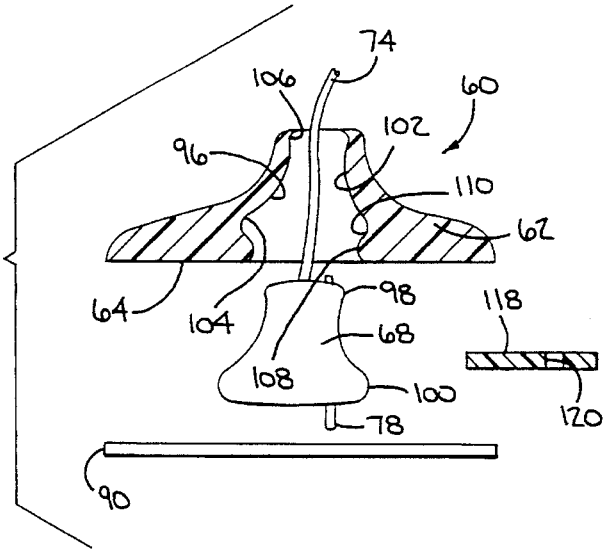
FIG. 6 is an exploded, partial cross-sectional view of the inventive security apparatus in FIGS. 3–5.

In one form, this void is filled by a flexible insert 118, as shown in FIG. 6. The insert 118 has a guide opening 120 for the button 78 to insure that it is properly aligned. The adhesive layer 90 is placed over the insert 118 to captively hold it in place.

Figure 7:
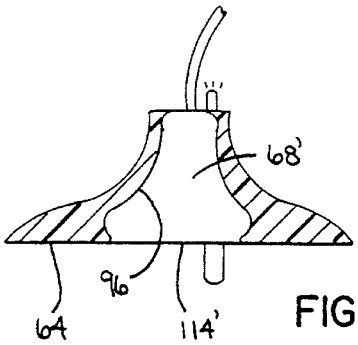
FIG. 7 is a partial cross-sectional view of a modified form of security apparatus according to the present invention.

Alternatively, as shown in the embodiment in FIG. 7, a housing 68' can be configured to fully fill the receptacle 96 so that the bottom surface 114' on the housing 68' is flush with the body surface 64.

The body 62 is readily conformable by reason of making the central portion 122 of the body to have a substantially greater thickness (T) than the thickness (T1) of a peripheral flange 124 that extends around the central portion 122.

Figure 8:
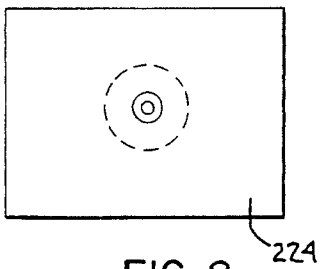
FIG. 8 is a bottom view of a body on the inventive security apparatus showing one form of article-engaging surface on the body.
Figure 9:
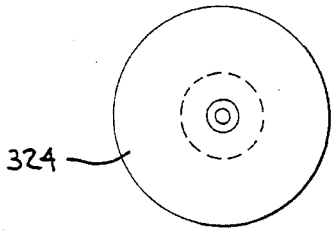
FIG. 9 is a view as in FIG. 8 of a modified form of body and article-engaging surface.
Figure 10:
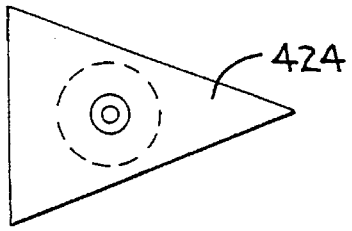
FIG. 10 is a view as in FIGS. 8 and 9 of a further modified form of body and article-engaging surface.
Figure 11:
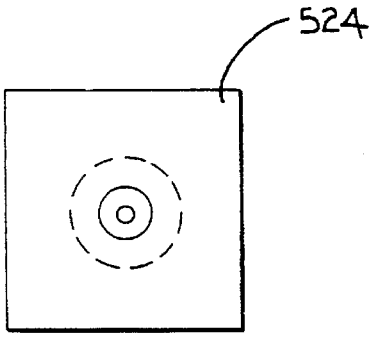
FIG. 11 is a view as in FIGS. 8–10 of a still further modified form of body and article-engaging surface.

To make the body 62 even more versatile and readily conformable to differently shaped articles, the shape of the flange 124 can be varied as shown in FIGS. 8–11. In FIG. 8 a rectangular flange 224' is shown, in FIG. 9 a circular flange 324" is shown, in FIG. 10 a triangular flange 424''' is shown, and in FIG. 11 a square flange 524'''' is shown.

Figure 12:
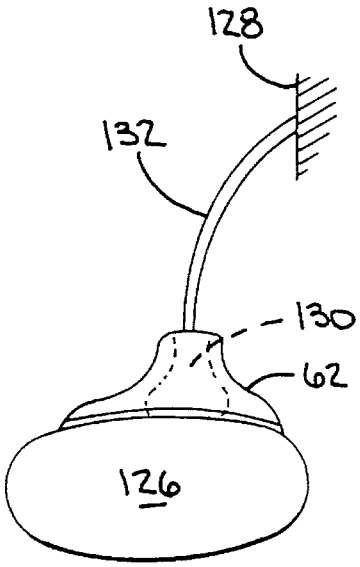
FIG. 12 is a side elevation view of a security apparatus, according to the present invention, using a mechanical connection between a body on the apparatus and a fixed base/support relative to which an article is to be fixed.

The inventive concept can also be used to effect a purely mechanical connection between an article 126 and a fixed base/support 128, as shown in FIG. 12. The body 62 can be made with the construction described above with a housing 130, corresponding to the housing 68 above, having a solid metal form that is fixedly attached to a flexible cord 132, that is in turn fixedly attached to the support/base 128. The cord 132 can be a braided metal cord, a solid metal cord, a hollow metal cord, or a cord made from another suitable material known to those skilled in the art.

The foregoing disclosure of specific embodiments is intended to be illustrative of the broad concepts comprehended by the invention.

We claim:

1. A security apparatus for attachment to an article to be monitored, said security apparatus comprising:

a body;

first means for maintaining the body operatively connected to the article to be monitored; and second means on the body for at least one of a) mechanically connecting the body to a base relative to which the article to be monitored is to be confined and b) changing from a first state with the body operatively connected to the article to be monitored into a second state as with the body at least partially separated from the article to be monitored, said body having at least a part that is conformable to a surface on the article to which the security apparatus is to be connected, wherein the conformable part of the body is made from a material that can be reconfigured into a plurality of different shapes and maintains itself in the plurality of different shapes, wherein the conformable part of the body comprises thermal setting rubber.

2. A security apparatus for attachment to an article to be monitored, said security apparatus comprising:

a body;

first means for maintaining the body operatively connected to the article to be monitored; and second means on the body for at least one of a) mechanically connecting the body to a base relative to which the article to be monitored is to be confined and b) changing from a first state with the body operatively connected to the article to be monitored into a second state as with the body at least partially separated from the article to be monitored, said body having at least a part that is conformable to a surface on the article to which the security apparatus is attached, wherein the conformable part of the body is made from a deformable material that defines a first surface that is conformed to the underlying surface on the article to be monitored and the first means comprises an adhesive that acts between the first surface and the underlying surface on the article to be monitored, wherein the part of the body comprises thermal setting rubber that defines the first surface.

3. A security system for monitoring an article, said system comprising:

a body;

first means for maintaining the body operatively connected to the article to be monitored;

a control unit remote from the body; and means for establishing an electrical circuit between the control unit and the body, said control unit including second means for sensing that the electrical circuit has been broken and generating a signal indicative of the fact that the electrical circuit has been broken as when said body is at least partially separated from the article to be monitored, there being means on at least one of the control unit and body for giving a sensory indication that the electrical circuit is broken in response to the signal being generated by the second means, said body having at least a part that is conformable to a surface on the article to which the body is attached, wherein the conformable part of the body is made from a material that can be reconfigured into a plurality of different shapes and maintains itself in the plurality of different shapes, wherein the first means comprises means for fixedly mounting at least a part of the conformable part of the body against the article to be monitored with the body operatively connected to the article to be monitored.

4. A security system for monitoring an article, said system comprising:

a body;

first means for maintaining the body operatively connected to the article to be monitored;

a control unit remote from the body; and means for establishing an electrical circuit between the control unit and body, said control unit including second means for sensing that the electrical circuit has been broken and generating a signal indicative of the fact that the electrical circuit has been broken as when said body is at least partially separated from the article to be monitored, there being means on at least one of the control unit and body for giving a sensory indication that the electrical circuit is broken in response to the signal being generated by the second means, said body having at least a part that is conformable to a surface on the article to which the body is attached, wherein the conformable part of the body comprises thermal setting rubber.

5. A security system for monitoring an article, said system comprising:

a body;

first means for maintaining the body operatively connected to the article to be monitored;

a control unit remote from the body; and means for establishing an electrical circuit between the control unit and body, said control unit including second means for sensing that the electrical circuit has been broken and generating a signal indicative of the fact that the electrical circuit has been broken as when said body is at least partially separated from said article, there being means on at least one of the control unit and body for giving a sensory indication that the electrical circuit is broken in response to the signal being generated by the second means, said body having at least a part that is conformable to a surface on the article to which the body is attached, wherein the body has a thickness taken transversely to a surface on the article to which the body is attached, the body has a central portion with a first thickness and a peripheral flange having a thickness less than the first thickness and defining at least a part of the part of the body that is conformable, wherein the flange is made from thermal setting rubber.

6. A security apparatus for attachment to an article to be monitored, said security apparatus comprising:

a body;

first means for maintaining the body operatively connected to the article to be monitored; and second means on the body for at least one of a) mechanically connecting the body to a base relative to which the article to be monitored is to be confined and b) changing from a first state with the body operatively connected to the article to be monitored into a second state as with the body at least partially separated from the article to be monitored, said body having at least a part that is conformable to a surface on the article to which the security apparatus is to be connected, wherein the conformable part of the body is made from a material that can be reconfigured into a plurality of different shapes and maintains itself in the plurality of different shapes independently of the article to which the security apparatus is to be connected and without any external force being applied to the body.

7. The security apparatus according to claim 6 in combination with means for sensing the state of the second means and producing a signal as an incident of the sensing means sensing that the second means is in the second state and means responsive to the signal for producing a sensory indication at at least one of a) the security apparatus and b) a location remote from the security apparatus.

8. The security apparatus according to claim 6 in combination with an article to be monitored.

9. A security apparatus for attachment to an article to be monitored, said security apparatus comprising:

a body;

first means for maintaining the body operatively connected to the article to be monitored; and second means on the body for at least one of a) mechanically connecting the body to a base relative to which the article to be monitored is to be confined and b) changing from a first state with the body operatively connected to the article to be monitored into a second state with the body at least partially separated from the article to be monitored, said body having at least a part comprising thermal setting rubber that is conformable to a surface on the article to which the security apparatus is attached.

10. The security system according to claim 9 wherein the body has a surface that faces the article to be monitored and substantially the entire surface that faces the article to be monitored comprises thermal setting rubber.

11. The security system according to claim 9 in combination with the article to be monitored.

12. A security system for monitoring an article, said system comprising:

a body;

first means for maintaining the body operatively connected to the article to be monitored;

a control unit remote from the body; and means for establishing an electrical circuit between the control unit and body, said control unit including second means for sensing that the electrical circuit has been broken and generating a signal indicative of the fact that the electrical circuit has been broken as when said body is at least partially separated from the article to be monitored, there being means on at least one of the control unit and body for giving a sensory indication that the electrical circuit is broken in response to the signal being generated by the second means, said body having at least a part that is conformable to a surface on the article to which the body is attached, wherein the body has a thickness taken transversely to a surface on the article to which the body is attached, the body has a central portion with a first thickness and a peripheral flange having a thickness less than the first thickness and defining at least a part of the part of the body that is conformable.

13. The security system according to claim 12 wherein the central portion of the body and the peripheral flange comprise a thermal setting rubber.

14. The security system according to claim 12 wherein substantially the entire body comprises thermal setting rubber.

15. The security system according to claim 12 wherein the central portion of the body defines a receptacle, a housing is provided, with there being a part of the electrical circuit on the housing, and the housing fits within the receptacle.

16. The security system according to claim 15 wherein there are means cooperating between the body and housing for allowing the housing to be press fit into an operative position on the body.

17. The security system according to claim 15 wherein there are means cooperating between the body and housing for allowing the housing to be snap fit into an operative position on the body.

18. A security apparatus for attachment to an article to monitored, said security apparatus comprising:

a body;

first means for maintaining the body operatively connected to the article to be monitored; and second means on the body for at least one of a) mechanically connecting the body to a base relative to which the article to be monitored is to be confined and b) changing from a first state with the body operatively connected to the article to be monitored into a second state as with the body at least partially separated from the article to be monitored, said body having at least a part that is conformable to a surface on the article to which the security apparatus is to be connected, wherein the conformable part of the body is made from a material that can be reconfigured into a plurality of different shapes and maintains itself in the plurality of different shapes independently of the article to which the security apparatus is to be connected, wherein the conformable part of the body defines a first surface that can be conformed to an underlying surface on the article to be monitored and the first means comprises an adhesive that acts between the first surface and the underlying surface on the article to be monitored.

19. The security apparatus according to claim 18 in combination with means for sensing the state of the second means and producing a sensory indication as an incident of the sensing means sensing that the second means is in the second state.

20. The security apparatus according to claim 18 wherein the second means comprises a cable connected to the base that is one of a) a braided metal wire, b) a solid metal wire, and c) a hardened metal wire.

21. The security apparatus according to claim 18 wherein the second means comprises a housing containing at least a part of an electrical circuit providing said first and second states and the housing is made from a second material that is different than the conformable material.

22. The security apparatus according to claim 21 wherein the second material is a hard plastic.

23. The security apparatus according to claim 21 wherein the electrical circuit includes a switch, said switch comprising a button and means for mounting the button to the housing for movement between a first position and a second position constituting said second and first states, respectively, said electrical circuit being open with the button in the first position, said button projecting from the housing with the body fully separated from the article to be monitored, and being pressed against the article to be monitored and urged by the article to be monitored from its first position into its second position with the body in an operative position on the article to be monitored.

24. The security apparatus according to claim 21 in combination with an electrical lead that defines part of the electrical circuit and means connected to said electrical lead for sensing that the electrical circuit is broken and producing a sensory indication as an incident of the sensing means sensing that the electrical circuit is broken.

25. The security apparatus according to claim 21 wherein the body has a thickened portion defining a receptacle to accept the housing.

26. The security apparatus according to claim 25 wherein the receptacle extends fully through the body.

27. The security apparatus according to claim 21 wherein the housing has a substantially fixed, rigid shape and there are means cooperating between the housing and body for allowing the housing to be press fit into, and releasably maintained in, an operative position on the body.

28. The security apparatus according to claim 27 wherein the cooperating means comprises a male element on one of the body and housing and a female element on the other of the body and housing that is complementary to the male element and receives the male element with the housing in the operative position on the body.

29. The security apparatus according to claim 28 wherein the male element comprises an annular rib and the female element comprises an annular groove and with the housing and body separated from each other and the housing aligned relative to the body in a first position, the housing can be pressed into its operative position, there being a part of the other of the body and housing that abuts the rib as the housing is moved from its first position into its operative position, whereupon the body deforms to allow the rib to seat in the groove with the housing in the operative position.

* * * * *